US009222309B2

(12) United States Patent
Fagg

(10) Patent No.: US 9,222,309 B2
(45) Date of Patent: Dec. 29, 2015

(54) DRILLING APPARATUS INCLUDING MILLING DEVICES CONFIGURED TO ROTATE AT DIFFERENT SPEEDS

(75) Inventor: Hayden V. Fagg, White Oak, TX (US)

(73) Assignee: Baker Hughes Incorporated, Houston, TX (US)

( * ) Notice: Subject to any disclaimer, the term of this patent is extended or adjusted under 35 U.S.C. 154(b) by 558 days.

(21) Appl. No.: 13/294,529

(22) Filed: Nov. 11, 2011

(65) Prior Publication Data

US 2013/0118811 A1 May 16, 2013

(51) Int. Cl.

| | |
|---|---|
| ***E21B 4/20*** | (2006.01) |
| ***E21B 4/02*** | (2006.01) |
| ***E21B 7/00*** | (2006.01) |
| ***E21B 10/43*** | (2006.01) |

(52) U.S. Cl.

CPC ..... *E21B 7/002* (2013.01); *E21B 10/43* (2013.01)

(58) Field of Classification Search

CPC ..... E21B 4/02; E21B 7/002; E21B 4/20
USPC ..... 175/57, 96, 107
See application file for complete search history.

(56) References Cited

U.S. PATENT DOCUMENTS

| | | | | |
|---|---|---|---|---|
| 3,014,542 | A * | 12/1961 | Hildebrandt et al. | 175/107 |
| 3,181,631 | A | 5/1965 | Nielsen | |
| 4,267,893 | A * | 5/1981 | Mannon, Jr. | 175/65 |
| 4,311,443 | A * | 1/1982 | Clark et al. | 418/48 |
| 4,665,997 | A * | 5/1987 | Maurer et al. | 175/107 |
| 4,775,017 | A * | 10/1988 | Forrest et al. | 175/65 |
| 5,778,992 | A * | 7/1998 | Fuller | 175/73 |
| 5,845,721 | A | 12/1998 | Southard | |
| 6,378,626 | B1 * | 4/2002 | Wallace | 175/19 |
| 7,610,970 | B2 | 11/2009 | Sihler et al. | |
| 2006/0237234 | A1 * | 10/2006 | Dennis et al. | 175/95 |
| 2010/0181112 | A1 | 7/2010 | Radford et al. | |
| 2012/0292112 | A1 * | 11/2012 | Lakic | 175/57 |

OTHER PUBLICATIONS

Southard, Robert; "New Assembly Drills Without Reactive Torque," SPE/IADC 105000, 2007 SPE/IADC Drilling Conference, Amsterdam, The Netherlands, Feb. 20-22, 2007, pp. 1-7.

* cited by examiner

*Primary Examiner* — Kenneth L Thompson
(74) *Attorney, Agent, or Firm* — Cantor Colburn LLP

(57) ABSTRACT

In one aspect, an apparatus for forming a borehole is provided that in one embodiment may include a first milling device configured to rotate at a first rotational speed in a first direction, and a second milling device around the first milling device configured to rotate at a second rotational speed in a second direction, wherein the rotational first speed is greater than the second rotational speed. In another aspect, the first and the second milling devices may be configured to rotate in the same direction at different speeds.

16 Claims, 2 Drawing Sheets

DRILLING APPARATUS INCLUDING MILLING DEVICES CONFIGURED TO ROTATE AT DIFFERENT SPEEDS

BACKGROUND INFORMATION

1. Field of the Disclosure

This disclosure relates generally to drilling or milling devices for drilling boreholes in earth formations using same.

2. Brief Description of the Related Art

Boreholes are drilled in earth formations using a drilling system for a variety of purposes, including production of hydrocarbons, such as oil and gas. A drilling system typically includes a drill string that includes a drilling tubular having a drilling assembly at the end of the tubular. In some cases the drilling assembly includes a drill bit (also referred to herein as a "milling device") and an outer milling device (also referred to herein as "shoe") that encloses the drill bit. The drill bit is often rotated by a mud motor driven by a drilling fluid supplied under pressure from the surface to the drill string. The outer milling device is typically attached to the bottom of a tubular that encloses the mud motor. In operation, the drill string is rotated clockwise such that it rotates both the drill bit and the outer milling device in clockwise direction. The mud motor also rotates the drill bit in the clockwise direction, which rotation is superimposed on the rotation of the drill string.

The disclosure herein provides a drilling system wherein the drill bit and the outer milling device rotate at different speed and in one configuration in opposite directions to improve cutting of debris and plugs formed by the drilling process.

SUMMARY

In one aspect, an apparatus for forming a borehole is provided that in one embodiment may include a first milling device configured to rotate at a first rotational speed in a first direction, and a second milling device around the first milling device configured to rotate at a second rotational speed in a second direction, wherein the rotational first speed is greater than the second rotational speed. In another configuration the first and the second milling devices may rotate in the same direction at different speeds.

In another aspect, a method of providing a drilling tool is provided that in one embodiment may include providing a first milling device, coupling the first milling device to a motor configured to rotate the first milling device in a first direction, and placing a second milling device enclosing the first milling device, wherein the second milling device is configured to rotate in a second direction at a second speed that is less than the first speed. In another embodiment, the first and the second milling devices may be rotated in the same direction at different speeds.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF THE EMBODIMENTS

Figure 1:
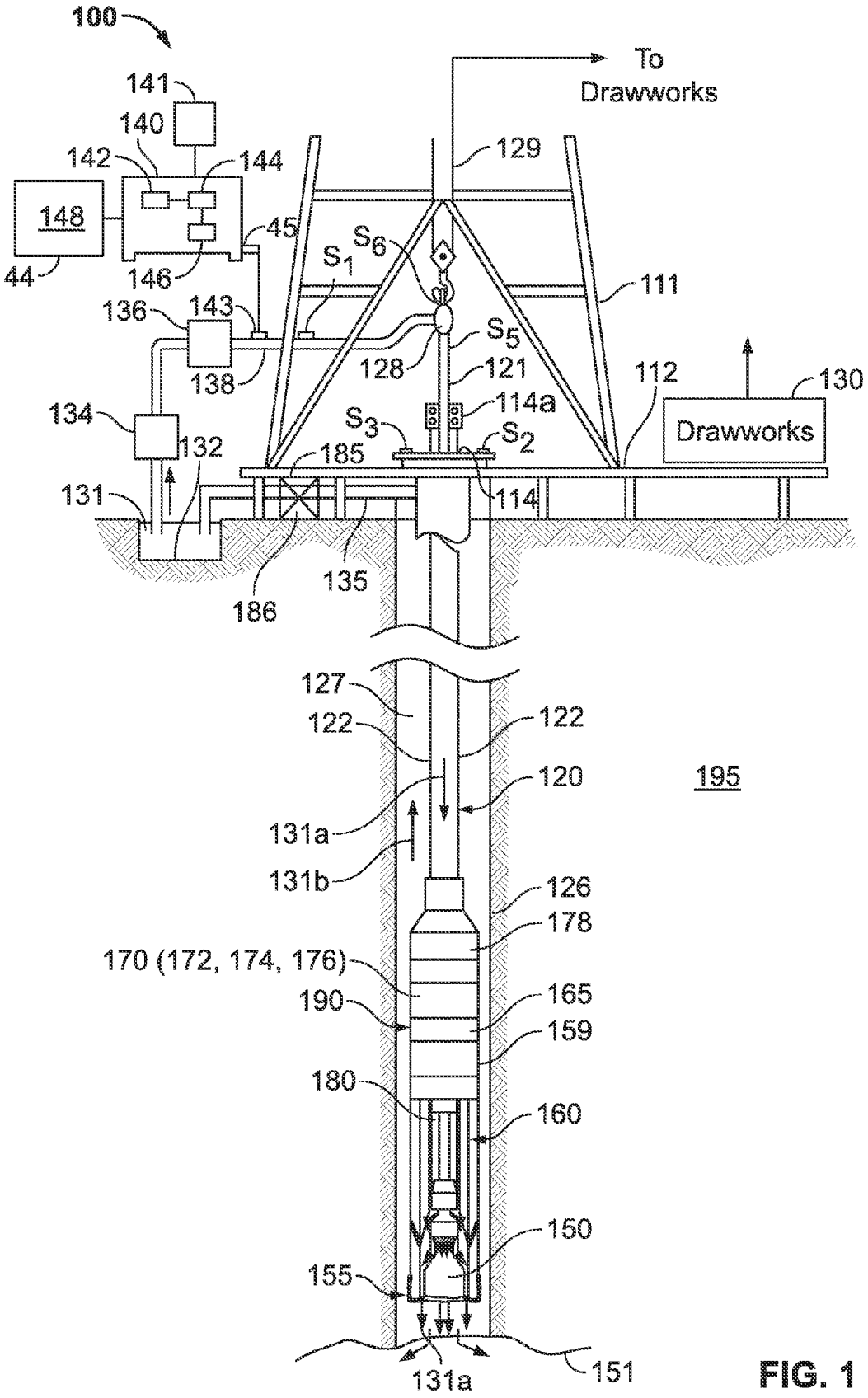
FIG. 1 is a drilling system utilizing a drilling tool made according to an embodiment of the disclosure.

FIG. 1 is a schematic diagram of an exemplary drilling system 100 that includes a drill string 120 configured to drill a borehole 126 in a formation 195 according to one embodiment of the disclosure. The drill string 120 includes a drilling tubular or tubing 122 (such as made by joining tubular members) and a drilling assembly or bottomhole assembly ("BHA") 190 attached to the bottom of the drilling tubular 122. The drilling system 100 further includes a conventional derrick 111 erected on a platform 112 that supports a rotary table 114 rotated by a prime mover, such as an electric motor (not shown), at a desired rotational speed. In other configurations, the drill string may be rotated by a top drive 114*a*. The drilling assembly 190 includes a drilling tool 160 that further includes an inner drill bit or milling device 150 and an outer milling device 155. The drill bit 150 is rotated by a drilling motor or mud motor 180 while the milling device 155 is rotated by the rotation of the drill string 120 from the surface. In aspects, the drill bit 150 and the milling device 155 are rotated in opposite directions for drilling the wellbore 126. For example, in one configuration, the milling device 155 is rotated by rotating the drill string 120 clockwise, while the drill bit 150 is rotated counterclockwise by a drilling motor 180, as described in more detail in reference to FIGS. 2A and 2B. The drill string 120 is coupled to a drawworks 130 via a Kelly joint 121, swivel 128 and line 129 through a pulley. Drawworks 130 is operated to control the weight on bit ("WOB"). In another configuration, the drilling motor 180 may be configured to rotate the drill bit 150 in clockwise direction at a speed different from the drill string speed.

In an aspect, to drill the wellbore 126, a suitable drilling fluid 131 (also referred to as the "mud") from a source 132, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150 and a bypass 245 between the drill bit 150 and the milling device 155. The returning drilling fluid 131*b* circulates uphole through an annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. Surface torque sensor $S_2$ and a sensor $S_3$ associated with the drill string 120 provide information about the torque and the rotational speed of the drill string 120. Rate of penetration of the drill string 120 may be determined from sensor $S_5$, while the sensor $S_6$ may provide the hook load of the drill string 120.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided by a program to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole devices and may control one or more operations of the downhole and surface devices.

The drilling assembly 190 may also contain formation evaluation sensors or devices (also referred to as measurement-while-drilling, "MWD," or logging-while-drilling, "LWD," sensors) for determining resistivity, density, porosity, permeability, acoustic properties, nuclear-magnetic resonance properties, corrosive properties of the fluids or the formation, salt or saline content, and other selected properties of the formation 195 surrounding the drilling assembly 190. Such sensors are generally known in the art and for convenience are collectively denoted herein by numeral 165. The drilling assembly 190 may further include a variety of other sensors and communication devices 159 for controlling and/or determining one or more functions and properties of the drilling assembly (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.

Still referring to FIG. 1, drilling assembly further may include a controller 170 that includes a processor 172, such as a microprocessor, a storage device 174, such as a solid state memory and programmed instructions 176, accessible to the controller 170 for controlling various aspects of the devices and sensors in the drilling assembly 190. A power generation device 178, such as turbine driven by the drilling fluid 131*a*, provides electrical power to the sensors 159 and 165. A telemetry unit 178 provides two-way data communication between the downhole controller 170 and the surface controller 140. Any suitable telemetry method may be utilized, including, but not limited to, mud pulse telemetry, acoustic telemetry, electromagnetic telemetry and wired pipe. Electrical conductor or optical fibers may be utilized for providing direct communication between the drilling assembly 190 and the surface equipment. During drilling of the wellbore, data from the downhole sensors 159 and 165 may be processed by the downhole controller 170 and/or the surface controller 140.

Figure 2A:
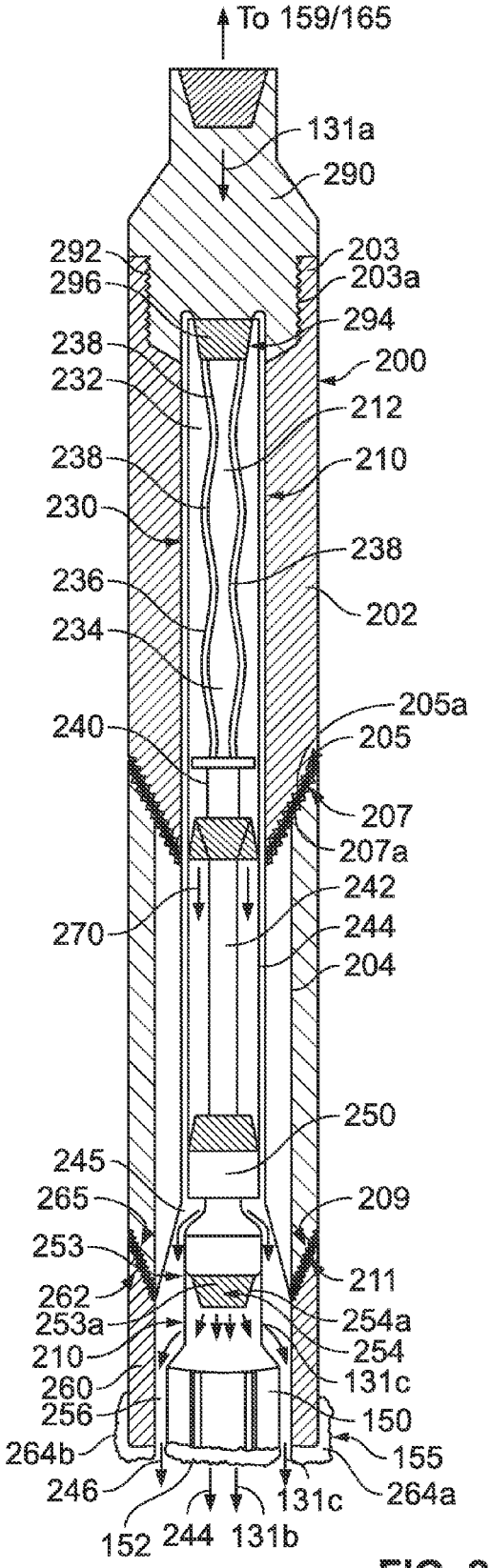
FIG. 2A is line diagram showing details of the drilling tool shown in FIG. 2.
Figure 2B:
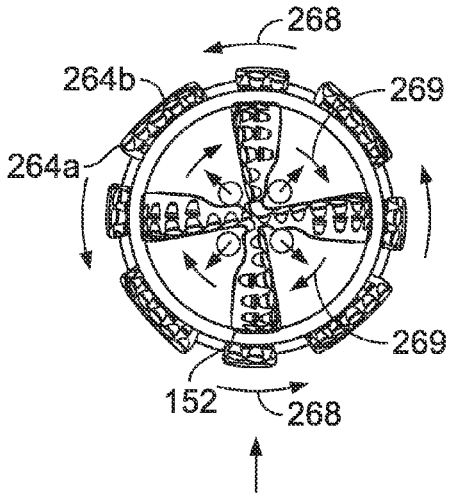
FIG. 2B shows the direction of an outer milling device as clockwise and that of an internal drill bit as counterclockwise.

FIG. 2A is line diagram of an exemplary drilling tool 200 configured to rotate the drill bit or milling device 150 (first milling device) one direction and a second milling device 155 in the opposite directions for drilling a wellbore. FIG. 2B is a view from the bottom of the tool 200 showing exemplary cutting surfaces of the milling devices 150 and 155 and the direction of rotation of these milling devices. The tool 200 is connected to devices, such as MWD sensors 165 and power unit 178 of a drilling assembly, such as drilling assembly 190 shown in FIG. 1, by a top sub 290. The tool 200 includes an upper housing 202 that includes an upper connection end 203 having right-hand threads 203*a* and a lower end 205 having right-hand threads 205*a* on an outer surface thereof. The top sub 290 connects to the upper end 203 of the top sub 202 via threaded end 292. The tool 200 further includes a lower sub 204 that has an upper end 207 that connects with the lower threads 205*a* at the lower end of the top sub 202 via right-handed threads 207*a* on an outer surface of the end 207. The tool 200 further includes a drilling sub 210 that includes the drill bit 150 and the milling device 155. The drilling sub 210 has a right-handed threaded end 211 that connects to the right-handed threaded end 209 of the lower sub 204. The right-handed threaded connections 290 between the top sub 290, upper housing 202, between upper housing 202 and the lower housing 204 and between the lower housing 204 and the drilling sub 210 enable the tool 200 to rotate clockwise when the drill string 120 (FIG. 1) is rotated clockwise. Alternatively, the upper sub 202 and the lower sub 204 may be made from a common member without the threaded ends 205 and 207.

The upper housing 202 and the lower housing 204 enclose a mud motor or drilling motor 230. In the configuration of FIG. 2A, the upper housing 202 is shown to enclose a power section 232 of the mud motor 230. The power section 232 is connected to the top sub 290 at connection 294 via left-handed threads 296. In one configuration, the power section 230 includes a rotor 234 disposed inside a stator 236. The rotor and stator combination forms cavities 238 of a progressive cavity motor or Moineau motor. The rotor 234 is configured to rotate counterclockwise when the drilling fluid 131*a* is supplied under pressure to the power section 232. The power section 232 is connected to a flexible shaft 240 that in turn connects to a drill shaft 242. The drilling shaft 242 is enclosed in a bearing housing 244 placed inside the lower housing 204. The drill shaft 242 is connected to the drill bit 150 at a connection 250. The drill bit 150 includes cutters 152 at its bottom and a neck section 254 having internal left-handed threads 254*a*. The drill shaft 242 connects to the threaded end 254 with end 253 having outer left-handed threads 253*a* that mate with the left-handed threads 254*a* of the neck section 254. Alternatively, the end 253 may be a box connection with internal left-handed threads and the drill bit neck section 254 may be a pin section with external left-handed threads. In either case, the connection 250 is such that the drill bit 150 may be rotated counterclockwise by the drilling motor 210. In one embodiment, the milling device 155 includes a housing 260 that has a threaded upper end 262. The milling device 155 includes cutting surfaces 264*a* at its bottom end and cutting surfaces 264*b* along its sides. The connection between the housing 260 and the lower sub 204 is shown at 265. The connection 265 includes right-handed threads so that the milling device 155 will rotate clockwise when the drill string 120 is rotated clockwise. Alternatively, the milling device 155 may be connected to the lower housing 204 by any other mechanical joining methods, such as welding. In an alternative configuration, the drilling motor may be configured to rotate the drill bit 150 clockwise at a speed different from the rotational speed of the outer milling device 155. In such a case, the threaded connections for the drilling motor will be right-handed.

Still referring to FIG. 2A, the tool 200 further includes a fluid passage 270 therethrough that allows a portion 131*b* of the drilling fluid 131*a* to discharge at the bottom of the drill bit 150, as shown by arrows 244. A portion 131*c* of the drilling fluid 131*a* is diverted to spacing or annulus 256 between the drill bit 150 and the milling device 155. The drilling fluid 131*c* discharges at the bottom 151 of the wellbore as shown by arrows 246. The fluid 131*c* prevents the rock pieces ("cuttings") disintegrated by the drill bit 150 and the milling device 155 from reentering the spacing 256. FIG. 2B shows the direction of the milling device 155 as clockwise by arrows 269 and that of the drill bit 150 as counterclockwise by arrows 269.

Referring now to FIGS. 1 and 2A, in one configuration, to drill the wellbore 126, the drilling fluid 131*a* is supplied under pressure at the surface to the drilling tubular 122 while rotating the drill string 120 clockwise by rotating the rotary table 114 or by the top drive 114*a*. Since the milling device 155 is connected to the drill string 120 via right-handed threads, it rotates clockwise at the rotational speed of the drill string 120. The drilling fluid 131*a* passes through the power section 212 of the mud motor 210, causing the rotor 234 to rotate counterclockwise, which rotates the drill bit 150 counterclockwise at the rotational speed of the rotor 234. Typically, the mud motor 210 rotates at a substantially higher speed than the drill string rotational speed. In the configuration shown, the effective or net rotation speed of the drill bit 150 is the difference between the rotational speed of the mud motor 210 and the rotational speed of the drill string drill 120. For example, if the mud motor 210 rotates at 500 rpm counterclockwise and the drill string 120 rotates at 100 rpm clockwise, then the effective rotational speed of the drill bit 150 will be 500 rpm (500-100). Although, the embodiments herein are described wherein the drill string is rotted clockwise and the drill bit is rotated counterclockwise, their rotational direction may be reversed by reversing the threaded connections.

In aspects, milling a borehole by rotating a first milling device in a first direction and in a second and opposite direction by a second milling device enclosing the first device, in some application may overcome the "stall" of the drilling motor used to rotates one of the milling devices. Specifically, an inner drill bit rotating in one direction and an outer milling device or shoe rotating in the opposite direction can "chew up" plugs and debris at a faster rate than when the two devices are rotated in the same direction, which can improve the efficiency of the drilling tool. In the embodiments shown herein, the drilling tubular and the outer milling device are configured to rotate clockwise because the drill strings are conventionally rotated clockwise. The disclosure herein equally applies to configurations wherein the outer milling device is rotated counterclockwise and the inner drill bit is rotated clockwise.

As discussed earlier, in the case of conventional drill strings utilizing conventional mud motors, both the drill string and the mud motors rotate clockwise, i.e., in the same rotational direction. In the present case, the threads throughout the inside mechanics of the tool are configured so that the outer housing and thus the outer milling device or the shoe rotates clockwise, while the mud motor and hence the inner milling device rotates in the reverse direction of the shoe, i.e. counter-clockwise. In aspects, the outer milling device or the shoe may include aggressive cutting edges or surfaces and that are in level with the bottom of the inner milling device so that both the inner and the outer milling devices work in unison, but in opposite direction, and contact the formation bottom (target) at the same time to drill the borehole. In the configurations described herein, the housing that encloses the mud motor is protected and thus may not need substantial maintenance. The outer milling device or the shoe, the mud motor power section and the bearing assembly are the wear components of the drilling tool. The flow diverter centered above the mud motor directs mud flow to both the outer milling device and the mud motor power section. In aspects, the mud motor may be made to closely resemble the current mud motors, with the rotor rotating in the counter-clockwise and providing right handed threads on the outer housings and the left-handed threads in the inner mud motor and drill bit connections.

In aspects, the drilling tool 200 described herein may be assembled in any desired manner. An exemplary method of assembling the tool 200 described in FIG. 2A may be as follows: connecting the top sub to the bottom end of the MWD string; connecting the upper housing to the top sub; connecting lower housing to the upper housing; sliding the mud motor into the upper housing and tightening the left-handed threaded connections from the mud motor up to the left handed pin connection on the top sub; connecting the mud motor and the drill bit; and joining the outer mill with the lower housing to complete the tool assembly.

The foregoing description is directed to particular embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. An apparatus for use in a wellbore, comprising:
- a drill string rotated from a surface location;
- a mud motor coupled to the drill string;
- a top sub coupled to the drill string, wherein the top sub is coupled to the mud motor and to a top housing;
- a first milling device coupled to the mud motor, wherein the mud motor is configured to rotate the first milling device at a first rotational speed in a first direction; and
- a second milling device coupled to the drill string and placed around the first milling device configured to rotate with the drill string at a second rotational speed in a second direction, wherein the top housing is coupled to the second milling device via a bottom housing.

2. The apparatus of claim 1, wherein the first rotational speed is greater than the second rotational speed.

3. The apparatus of claim 1, wherein the first direction is counterclockwise and the second direction is clockwise.

4. The apparatus of claim 1, wherein the motor includes a left-handed threaded connection for coupling to the top sub to enable the motor to rotate the first milling device counterclockwise.

5. The apparatus of claim 1, wherein the first milling device includes a fluid flow path configured to enable a drilling fluid supplied to the first milling device to discharge at a bottom of the first milling device.

6. The apparatus of claim 1 further comprising a fluid flow path between the mud motor and the outer top housing.

7. The apparatus of claim 6 further comprising a fluid bypass associated with the first milling device that allows a portion of the fluid supplied to the first milling device to flow into the fluid path between the first milling device and the second milling device and discharge at a bottom of the first and second milling devices.

8. A method of providing a drilling tool, comprising:
- providing a top sub;
- coupling an upper housing to the top sub;
- coupling a lower housing to the upper housing;
- coupling a mud motor to the top sub;
- coupling a first milling device to the mud motor, wherein the mud motor is configured to rotate the first milling device at a first speed in a first direction; and
- joining a second milling device to the lower housing, wherein the second milling device is configured to rotate in a second direction at a second speed; and
- coupling a drill string to the top sub, wherein the drill string is configured to be rotated in the second direction so as to rotate the second milling device in the second direction.

9. The method of claim 8, wherein the first direction is counterclockwise and the second direction is clockwise.

10. The method of claim 8 further comprising coupling the mud motor to the first milling device to rotate the first milling device at the first speed.

11. The method of claim 8 further comprising rotating the first milling device by the mud motor in the first direction and rotating the second milling device by rotating a drill string coupled to the second milling device in the second direction.

12. The method of claim 11 further comprising rotating the drill string by a prime mover at the surface.

13. The method of claim 10 further comprising supplying a fluid to the motor to rotate the motor in the first direction.

14. The method of claim 8 further comprising providing a fluid flow path between the first milling device and the second milling device that allows a fluid to discharge at a bottom of the second milling device.

15. The method of claim 14 further comprising bypassing a fluid supplied to the drill string to the fluid flow path between the first milling device and the second milling device.

16. The method of claim 8 further comprising connecting the second milling device to a housing enclosing the first milling device.

* * * * *